United States Patent [19]

Mahon

[11] 3,965,312

[45] June 22, 1976

[54] PERCENTAGE TIMER

[75] Inventor: Joseph J. Mahon, Libertyville, Ill.

[73] Assignee: Deltrol Corporation, Bellwood, Ill.

[22] Filed: Mar. 20, 1975

[21] Appl. No.: 560,552

[52] U.S. Cl. ..... 200/39 R

[51] Int. Cl.[2] ..... H01H 7/08; H01H 43/10

[58] Field of Search ..... 200/36, 37 R, 38 R, 200/38 B, 38 C, 39 R, 39 A, 30 R, 31 A; 74/54, 568 R, 568 T, 569

[56] References Cited

UNITED STATES PATENTS 3,699,281 10/1972 Harris ..... 200/39 R X

*Primary Examiner*—James R. Scott

*Attorney, Agent, or Firm*—John L. Harris

[57] ABSTRACT

A continuous repeat cycle timer in which the on period is externally adjustable. The beginning of the on period is fixed, being started by a cam follower dropping into a notch in the periphery of a cam. The end of the on period is determined by axial movement of a second cam which releases a latch. The point of axial latch releasing movement is set by an adjusting cam which is rotatable by an external knob. The cam shaft for the operating cams extends through the knob and indicates the progress of the time cycle.

10 Claims, 4 Drawing Figures

PERCENTAGE TIMER

BACKGROUND OF THE INVENTION

This invention relates in general to timers and more particularly to percentage timers.

Percentage timers as known in the art are timers driven on a fixed time cycle in which an adjustment is provided to allow the user to set the time that the switch is open or closed.

One type of percentage timer is shown in the Harris U.S. Pat. No. 3,723,676 dated Mar. 27, 1973. This patent incorporates a stationary switch which drops off a cam to close, and is held closed by a latch. This latch is released by a cam follower riding a second cam. The release point is set by an adjusting cam and follower which bodily shifts the latch cam follower.

BRIEF SUMMARY OF INVENTION

The primary object of the invention is to provide a simple and rugged percentage timer requiring fewer parts than heretofore required.

This is accomplished by utilizing a cam operated latch trip principle. A cam follower riding the peripheral surface of a rotating cam drops off a ledge on the cam, operating the switch with snap action in one direction. A latch holds the switch in this position and is tripped by axial motion caused by a side camming surface. The point at which the latch tripping axial motion occurs in the time cycle is adjusted by a side surface adjusting cam.

A further object of the invention is to provide a percentage timer giving visual indication of the time cycle.

Other objects will appear from the following detailed description and the appended claims.

DETAILED DESCRIPTION OF THE INVENTION

Figure 2:
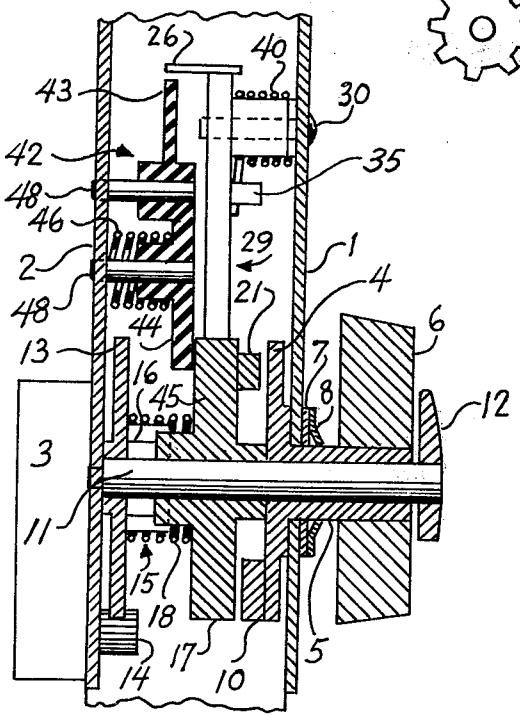
FIG. 2 is a schematic side sectional view.

Referring to FIG. 2 the timing mechanism is mounted between a front plate 1 and a back 2 which supports a timing motor 3. An adjusting cam 4 is mounted adjacent the front plate 1 and is formed with a hollow hub 5 extending through this plate and carrying an adjusting knob 6. A tension washer 7 is mounted over the outside of the hub and is held in place by a retainer 8 which is pressed over the hub 5. The tension washer 7 serves to hold the cam 4 against the front plate with substantial tension, permitting rotation of the cam by the knob 6 but holding it in adjusted position. The cam 4 is in effect a relatively stationary axial cam and it includes an axial camming surface 10 which faces rearwardly.

Figure 1:
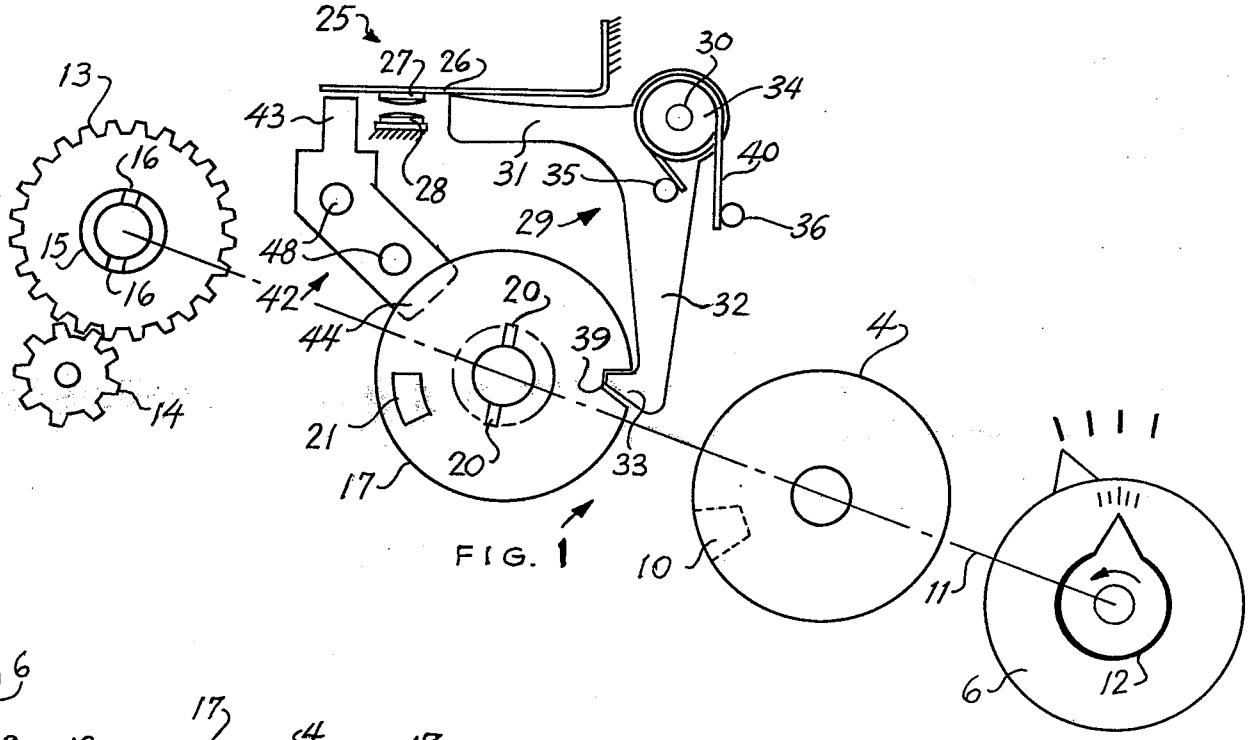
FIG. 1 is an exploded view of the percentage timer mechanism as seen from the front of the timer.

A shaft 11 is journaled in the back plate 2 and extends forwardly through the timer housing and through the hub 5 to a point in front of the adjusting knob 6. This shaft 11 carries a pointer 12 which indicates the position of the timing mechanism as will be described. A drive gear 13 is rigidly mounted on the inner end of the shaft 11 adjacent the back plate 2 and is driven by the timer motor pinion 14. This gear 13 is formed with a forwardly extending hollow hub 15 formed with opposed slots 16 which serve to drive a combination rotating and axially movable cam 17. This cam is biased by a spring 18 toward the front of the timer as shown in FIG. 2 and is formed with ears 20 (FIG. 1) which fit into the slots 16 of the driving hub 15. Cam 17 is also formed with an axial camming surface 21 which cooperates with the normally stationary but adjustable camming surface 10 on the adjusting cam 4. In operation the timer motor 3 drives the gear 13 in a counterclockwise direction as seen in FIG. 1. This drives the cam 17 in the same direction, this cam remaining in the location shown in FIG. 2 until the camming surface 21 on cam 17 engages the camming surface 10 on the adjusting cam 4. When this occurs the cam 17 moves rearwardly along shaft 10 and then returns to its normal forward position when the camming surfaces disengage.

Cam 17 by its combination rotary and axial motion operates timer switch 25 with snap action in both directions. This switch may include a switch blade 26 which is suitably anchored at its right hand end and carries a movable contact 27 cooperating with a stationary contact 28. This switch blade is biased downwardly for engaging the contacts and is moved to its upper position as shown by a cam follower 29 which is pivoted to a stationary pivot pin 30. Cam follower 29 is preferrably bell crank in shape having one leg 31 extending under the switch blade and another leg 32 extending downwardly and formed with a cam follower portion 33 which rides the periphery of cam 17. As shown in FIG. 1 the cam 17 is formed with a peripheral notch 39 into which the cam follower portion 38 is urged by a spring 40, this lifting the switch blade 26 to the position shown. Tension spring 40 is carried by hub 34 on the cam follower and has one leg bearing on stud 35 and its other leg bearing on a stationary stud 36.

The switch blade 26 is maintained in its upper position by a sliding latch 42. The upper end of this latch is formed with a latching surface 43 which normally extends under the left hand edge of switch blade 26 as shown in FIG. 2. The other end of the latch 42 is formed with a cam follower surface 44 which rides the rear surface 45 of cam 17. A spring 46 urges the sliding latch toward its latching position which is under blade 26 and in engagement with the cam surface 45. The latch 42 is suitably mounted so that it can slide forward and backward but is not free to rotate. The mounting means for the sliding latch may include a pair of spaced studs 48 mounted in the back plate 2 and extending through suitable openings formed in the latch member.

OPERATION

Figure 4:
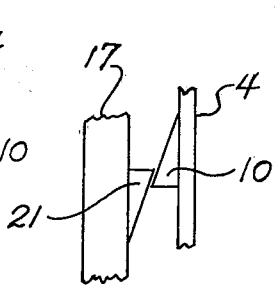
FIG. 4 is a similar view but showing the parts at the time of axial latch release.
Figure 3:
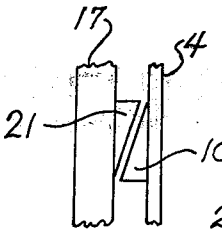
FIG. 3 is a fragmentary side view of the camming surfaces before axial motion is started.

With the parts in the positions shown in FIG. 1 the timer has just completed an on period, the cam follower 38 just having dropped into the cam notch 39 and lifting the blade 26 for disengaging contact 27 from contact 28. The cam follower in dropping into the cam notch raises the blade slightly above the end of latch 42, permitting the latch spring 46 to push the latch under the blade as shown in FIGS. 1 and 2. As the cam 17 continues counterclockwise rotation, it cams the cam follower 38 out of notch 39 onto the periphery of this cam. The switch 25 stays open as it is held there by the latch being in latching position. The cam 17 will continue rotating causing its axial camming surface 21 to approach the adjustable axial camming surface 10 on adjusting cam 4. As the two camming surfaces ride together the cam 17 slides rearwardly and carrying with it the latch 42. When the camming surfaces reach the relative positions shown in FIG. 4, the latching surface 43 rides off the edge of switch blade 26 allowing this blade to drop, engaging contact 27 with contact 28. The contacts will now stay engaged until cam follower 29 once again drops into the cam notch 39 which causes the contacts to open and the latch to return to latching position.

From the foregoing it will be seen that the end of each on period is at a fixed time determined by when the cam follower drops into the peripheral notch in the cam. The cam follower is immediately cammed out of the way leaving the latch 42 in sole control of the timer switch. The start of the on period is caused by releasing the latch and this time is variable by rotating the adjusting cam 4 by means of the external adjusting knob 6. This adjusting knob thus sets the percentage of time that the switch is closed for each revolution of the timer cam shaft. It will also be apparent that the indicator knob 12 in rotating with the cam shaft will indicate the time which must elapse before the timer terminates and on period.

The cam 17 while being a single part actually acts as two separate camming means, one being peripheral with a peripheral notch for actuating the cam follower, and the other converting rotary motion into axial motion for actuating the latch.

From the foregoing it will be apparent that the invention provides a simple and compact percentage timer which provides for snap action in both directions of a heavy duty switch and which also is adjustable by setting a knob on a stationary dial external to the timer. While a preferred form of the invention has been shown and described it is obvious that many changes may be made without departing from the spirit and scope of the invention as defined in the appended claims.

I claim:

1. In a timing device, the combination of, first cam means mounted for rotation, drive means for rotating said cam means about an axis, said cam means having a peripheral surface formed with a peripheral notch, second cam means mounted about an axis for compound rotary and axial movement, means for rotating said second cam means in a predetermined relationship with said first cam means, said second cam means having a side camming surface, a relatively stationary camming surface cooperating with said side camming surface to cause axial movement of the second cam means as it rotates, a control device, a cam follower biased toward the peripheral surface of said first cam means and riding same, said cam follower being arranged to actuate said control device from a first position to a second position when the cam follower drops into said peripheral notch, latch means arranged to hold the control device in said second position, and means actuated by axial movement of the second cam means for releasing said latch means at a predetermined angular position of the second cam means.

2. The combination recited in claim 1 in which both cam means rotate about a common axis and at the same speed.

3. The combination recited in claim 1 in which both cam means are embodied in a single part which both rotates and moves axially.

4. The combination recited in claim 1 in which the latch means is mounted for sliding motion in the same direction as the axial movement of the cam means, said latch means and control device being arranged to cause release of the latch means by said sliding motion.

5. The combination recited in claim 1 in which the relatively stationary camming surface is an adjustable cam arranged to rotate about the same axis as the second camming means.

6. The combination recited in claim 1 in which the drive means for rotating the first cam means includes a shaft arranged for rotation and bodily carries both of said cam means.

7. The combination recited in claim 6 in which the shaft extends outside the timing device and carries an indicator showing the angular position of at least one of the cam means.

8. The combination recited in claim 6 in which the relatively stationary camming surface is an adjustable cam rotatable about the same axis as said shaft.

9. The combination recited in claim 8 in which the shaft extends through the adjustable cam to outside of the timing device and serves to show the angular position of at least one of the cam means.

10. The combination recited in claim 9 in which the adjustable cam is provided with a knob outside of the timing device, the shaft extending through both the adjusting cam and the knob.

* * * * *